US009481513B2

(12) United States Patent
Warren et al.

(10) Patent No.: US 9,481,513 B2
(45) Date of Patent: Nov. 1, 2016

(54) WASTE CONTAINER

(75) Inventors: Kirk Warren, Cherry Hill, NJ (US); Alex Batista, Cherry Hill, NJ (US); Anne Brantley, Mt. Holly, NC (US); John Ford, Charlotte, NC (US); Michael Gatto, Deptford, NJ (US)

(73) Assignee: WASTEQUIP, LLC, Charlotte, NC (US)

( * ) Notice: Subject to any disclaimer, the term of this patent is extended or adjusted under 35 U.S.C. 154(b) by 689 days.

(21) Appl. No.: 13/567,733

(22) Filed: Aug. 6, 2012

(65) Prior Publication Data

US 2013/0084159 A1 Apr. 4, 2013

Related U.S. Application Data

(60) Provisional application No. 61/515,095, filed on Aug. 4, 2011.

(51) Int. Cl.

| | |
|---|---|
| ***B65D 8/04*** | (2006.01) |
| ***B65F 1/00*** | (2006.01) |
| ***B65F 1/02*** | (2006.01) |
| ***B65F 1/10*** | (2006.01) |
| ***B65F 1/12*** | (2006.01) |
| ***B65F 1/16*** | (2006.01) |
| ***B65F 1/14*** | (2006.01) |

(52) U.S. Cl.

CPC ..... *B65F 1/00* (2013.01); *B65F 1/0093* (2013.01); *B65F 1/02* (2013.01); *B65F 1/10* (2013.01); *B65F 1/122* (2013.01); *B65F 1/16* (2013.01); *B65F 1/1615* (2013.01); *B65F 1/1646* (2013.01); *B65F 2001/1489* (2013.01); *B65F 2250/111* (2013.01); *B65F 2250/112* (2013.01); *B65F 2250/114* (2013.01)

(58) Field of Classification Search

CPC ..... B65F 1/00; B65F 1/0093; B65F 1/02; B65F 1/10; B65F 1/122; B65F 1/16; B65F 1/1615; B65F 1/1646

USPC ..... 220/908

See application file for complete search history.

(56) References Cited

U.S. PATENT DOCUMENTS

| | | | | |
|---|---|---|---|---|
| 3,554,345 | A * | 1/1971 | Mullens | 193/33 |
| 4,280,780 | A * | 7/1981 | Neufeldt | 414/572 |
| 4,538,512 | A * | 9/1985 | Blough | 100/131 |
| 4,676,431 | A * | 6/1987 | Teske et al. | 232/43.1 |
| 5,360,132 | A * | 11/1994 | Edelhoff | 220/213 |
| 5,662,364 | A * | 9/1997 | Reeb et al. | 292/230 |
| 5,901,874 | A * | 5/1999 | Deters | 220/694 |
| 8,313,126 | B2 * | 11/2012 | Ferkovich et al. | 292/230 |
| 2012/0199590 | A1 * | 8/2012 | Therrien | 220/564 |

OTHER PUBLICATIONS

Humpback Container information page, Oct. 9, 2008, available at https://web.archive.org/web/20081009032539/http://www.con-fab.com/index.php?/products/detail/humpback.*

Humpback Container information page with image, undated, available at http://www.con-fab.com/humpbacks.*

Humpback Container, accessed at http://www.con-fab.com/pdfs/humpback-container-dims.pdf.

* cited by examiner

*Primary Examiner* — Michael McCullough
*Assistant Examiner* — Mark Hageman
(74) *Attorney, Agent, or Firm* — Nelson Mullins Riley & Scarborough LLP

(57) ABSTRACT

The present invention is generally applicable to a container. More specifically, the invention is applicable to a waste container for the collection, storage and transport of waste and refuse material. The waste containers of the present invention are particularly useful for the collection, storage and transporting of organic waste material.

23 Claims, 8 Drawing Sheets

WASTE CONTAINER

CROSS-REFERENCE TO RELATED APPLICATION

This application is a U.S. Non-Provisional Patent Application which claims priority to U.S. Provisional Patent Application Ser. No. 61/515,095, filed on Aug. 4, 2011 and titled "Waste Container," which is hereby incorporated by reference in its entirety.

TECHNICAL FIELD

The invention is generally applicable to a container. More specifically, the invention is applicable to a waste container for the collection, storage and transport of waste and refuse material. The waste containers of the present invention are particularly useful for the collection, storage and transporting of organic waste material, including but not limited to organic waste generated by the handling, storage, sale, preparation, cooking, and serving of foods, such as food scraps, grease, fruits, vegetables, dairy products, egg shells, coffee grounds, bread, grain, cheese, meat, poultry, fish, seafood, bones, fat, blood, entrails, or other animal tissue and organic waste generated in the process of landscape maintenance, such as leaves, branches, grass cuttings, or other plant material.

BACKGROUND OF INVENTION

Materials, such as waste and refuse materials, are frequently collected, stored and transported in large containers. It is desirable to provide such containers with one or more openings to facilitate the loading and unloading of the container. It is also desirable to provide such containers with a construction that is adapted to facilitate the transferring of the contents of the container to a waste removal vehicle, such as a garbage truck. Accordingly, there is a general need to provide a container for the collection, storage and transport of waste and refuse material with one or more openings to facilitate the loading and unloading of the container and with a construction that is adapted to facilitate the transferring of the contents of the container to a waste removal vehicle, such as a garbage truck.

Features and advantages of the invention will be set forth in part in the description which follows, and in part will be obvious from the description, or may be learned by practice of the invention. The accompanying drawings, which are incorporated in and constitute a part of this specification, illustrate several embodiments of the invention, and together with the description, serve to explain the principles of the invention.

DETAILED DESCRIPTION OF THE INVENTION

Figure 1A:
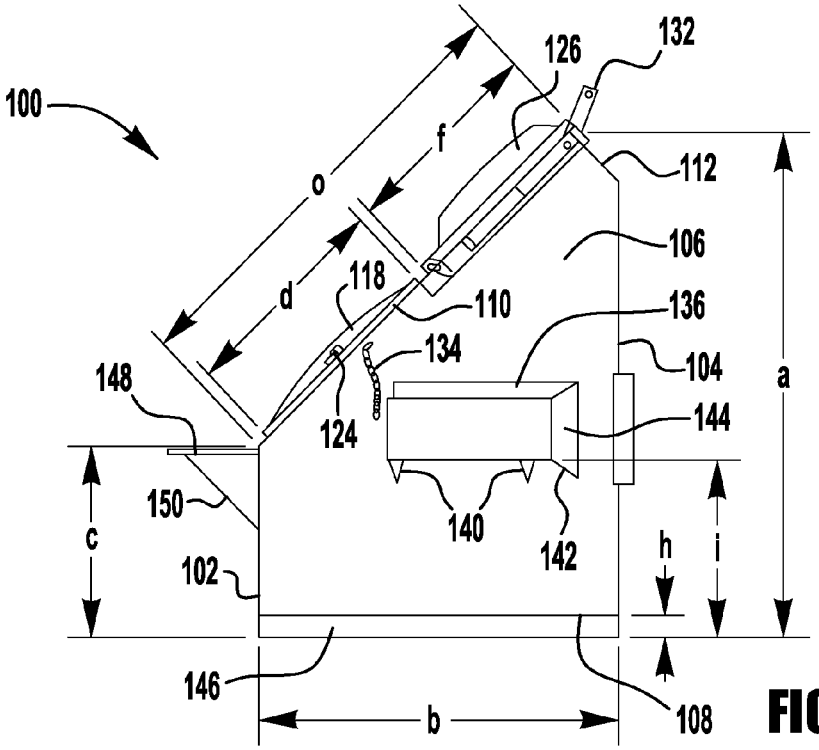
FIG. 1A shows a side view of one exemplary embodiment of a container.

The present invention will now be described with occasional reference to specific embodiments of the invention. This invention may, however, be embodied in different forms and should not be construed as limited to the embodiments set forth herein. Rather, these embodiments are provided so that this disclosure will fully convey the scope of the invention to those skilled in the art and are not intended to limit the scope of the invention in any way.

Also, while the detailed exemplary embodiments described in the specification and illustrated in the drawings relate to a container for the collection, storage and transport of waste and refuse materials, particularly organic waste, it should be understood that the container described herein may be used for the collection, storage and transport of any material and the container described herein is not limited to use with waste and refuse materials only. For example, the container described herein could be used for the collection, storage and transport of a variety of materials, including but not limited to, liquids, chemicals, bulk materials, grains, food ingredients, pellets of varying composition, plastics, cement, machinery parts or components, sand, mulch, gravel, or other materials.

Except as otherwise specifically defined herein, all terms used herein have the same meaning as commonly understood by one of ordinary skill in the art to which this invention belongs. The terminology used in the description of the invention herein is for describing particular embodiments only, and is not intended to be limiting of the invention. As used in the description of the invention, the singular forms "a," "an," and "the" are intended to include the plural forms as well, unless the context clearly indicates otherwise.

Unless otherwise indicated, all numbers expressing quantities, properties, and so forth as used in the specification are to be understood as being modified in all instances by the term "about." Accordingly, unless otherwise indicated, the numerical properties set forth in the following specification are approximations that may vary depending on the desired properties sought to be obtained in embodiments of the present invention. Notwithstanding that the numerical ranges and parameters setting forth the broad scope of the invention are approximations, the numerical values to the extent that such are set forth in the specific examples are reported as precisely as possible. Any numerical values, however, inherently contain certain errors necessarily resulting from error found in their respective measurements.

Figure 1B:
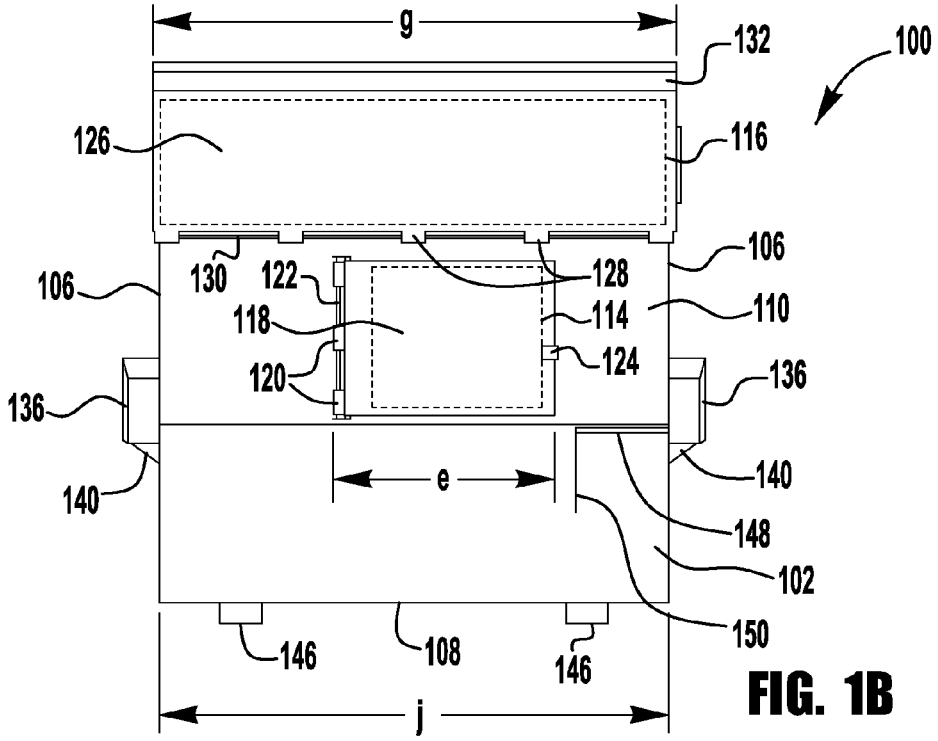
FIG. 1B shows a front, view of the embodiment of the container in FIG. 1A.

FIGS. 1A-1B show one exemplary embodiment of a container 100. Referring to FIGS. 1A-1B, the container 100 has a front wall 102, a rear wall 104, a pair of side walls 106 and a bottom wall 108. The illustrated embodiment of the container 100 includes an angled, upper front wall 110 and angled, upper rear wall 112. As shown in FIG. 1A, the upper front wall 110 slopes from the front wall 102 to meet the upper rear wall 112, and the upper rear wall 112 slopes from the rear wall 104 to meet the upper front wall 110 to generally enclose the container 100.

Figure 2A:
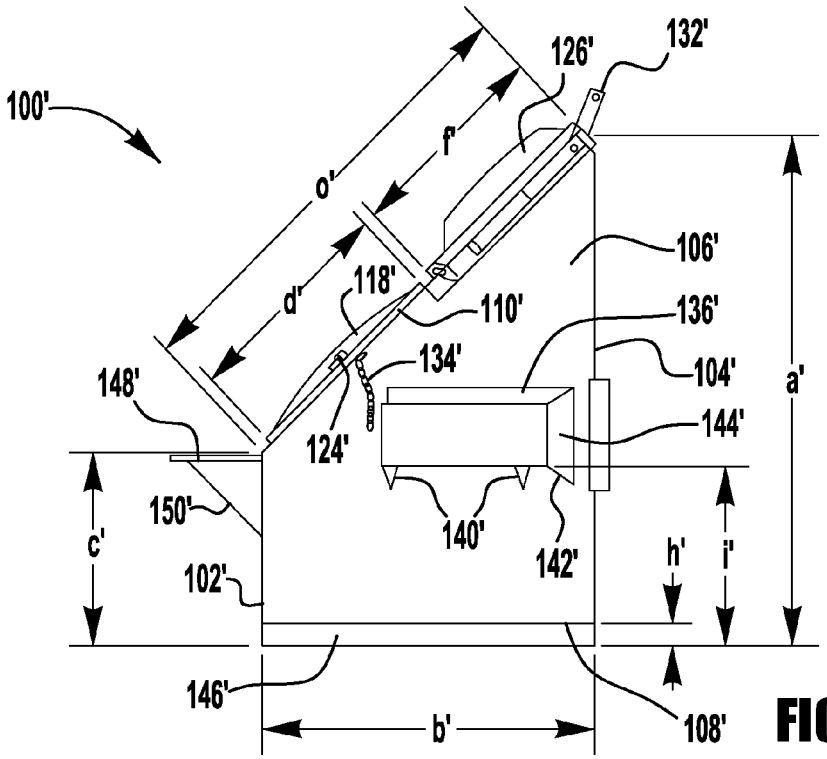
FIG. 2A shows a side view of a second exemplary embodiment of a container.
Figure 2B:
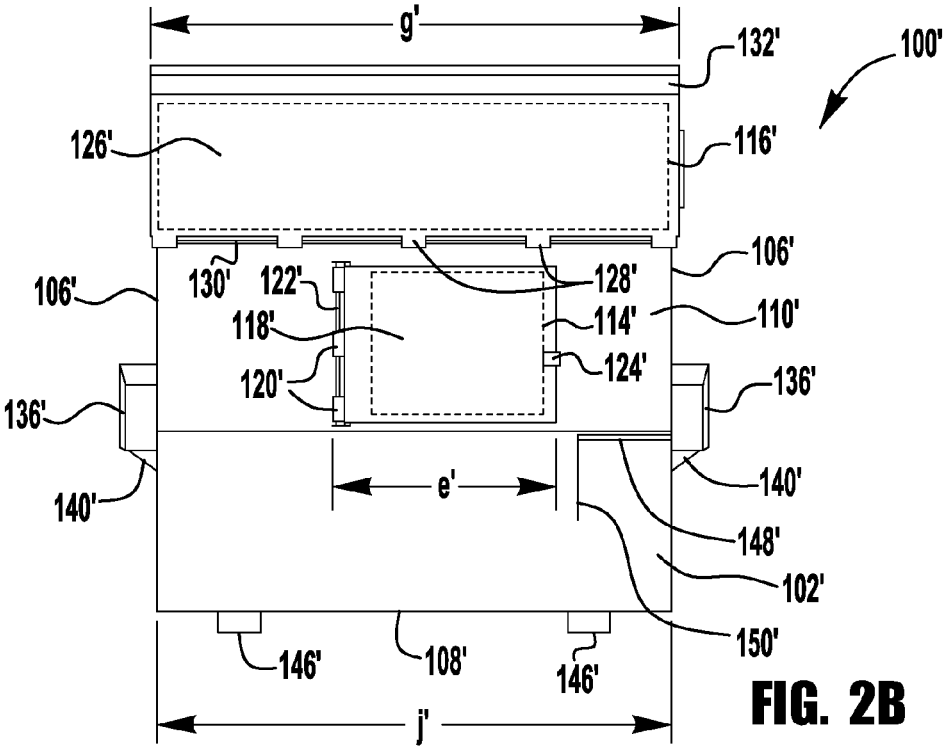
FIG. 2B shows a front view of the embodiment of the container in FIG. 2A.

The shape and configuration of each of walls 102, 104, 106, 108, 110 and 112 of container 100 may vary in various embodiments. In addition, the overall shape of container 100 may also vary in various embodiments. As shown in FIG. 1A, the exemplary embodiment of the container 100 has a generally five-sided polygonal shape when viewed from the side. However, the container 100 is not limited to the shape of the exemplary embodiment of container 100 and additional embodiments of the container 100 could have a variety of suitable shapes. For example, additional embodiments of the container 100 may not include a sloped, upper rear wall 112 (as shown in FIGS. 2A-2B). In such additional embodiments, the sloped, upper front wall 100 may slope from the front wall to meet the back wall 104, thus creating a container 100 with a generally, four-sided or quadrilateral shape when viewed from the side. Yet additional embodiments may not include a sloped, upper front wall or a sloped, upper rear wall, but rather be comprised of one or more cubic shaped sections. In addition, while the exemplary embodiment of the container 100 has a generally rectangular horizontal cross section (i.e., the shape of the base of the container 100 when viewed from above), additional embodiments of the container may possess different horizontal cross-sectional shapes. For example, certain embodiments of the container may have a generally square, elliptical, circular or other horizontal cross sectional shape.

The container 100 of the present application may have a variety of different sizes. The exemplary embodiment of container 100 illustrated in FIGS. 1A-1B has a capacity of approximately 3 cubic yards (i.e., leak-free capacity below fill opening when container is on substantially level surface). However, additional embodiments of the container may be of a variety of suitable sizes, including but not limited to 2, 4, 6, 8, 10 cubic yards or various other sizes. The front wall 102, rear wall 104, pair of side walls 106, bottom wall 108, upper front wall 110 and upper rear wall 112 of the container 100 according to the present invention may be formed of one or more of a variety of suitable materials. The particular material is generally selected to be compatible with the intended purpose and desired qualities of the container 100.

In various embodiments, the walls 102, 104, 106, 108, 110 and 112 of container 100 may be made from one or a combination of metals, such as steel or aluminum. In various additional embodiments, the walls 102, 104, 106, 108, 110 and 112 of container 100 may be made from one or a combination of thermoplastic or elastomeric materials, such as plastic. The container 100 may be manufactured by one of a variety of methods of making containers that are well known in the art. For example, containers 100 with metal walls can be constructed by welding the walls together and containers with walls of thermoplastic or elastomeric materials, may be constructed by a molding process, such as a rotational molding process.

Use of a variety of materials in making the container 100 permits the selection of a broad range of possible material properties, including the properties of rigidity, flexibility, elasticity, thermal and chemical resistance, odor resistance, corrosion resistance, electrical resistance/conductance, mechanical abrasion resistance, color, transparency/opacity and texture. According to some embodiments of the invention, the container 100 is made entirely from one material that has uniform properties. According to other embodiments of the invention, various parts of the container 100 are made from different materials to provide varied properties at discrete portions of the container 100. For example, in certain embodiments, all or a portion of some of the walls 102, 104, 106, 108, 110 and 112 may be formed of metal while the remaining walls or wall portions are formed of thermoplastic or elastomeric materials As shown in FIG. 1B, the exemplary embodiment of container 100 includes a fill opening 114 and discharge opening 116 (both shown in broken lines in FIG. 1B) defined within the sloped, upper front wall 110. The filling opening 114 is generally provided to facilitate the loading of container 100 with waste or other materials by a user, as described in greater detail herein. The discharge opening 116 is generally provided to facilitate the discharging of contents of container 100 into a waste removal vehicle, such as a garbage truck, as described in greater detail herein. However, the fill opening 114 and discharge opening 116 are not so limited in practice. For example, the discharge opening 116 could be used for both the purpose of loading waste or other materials into container 100 and discharging the contents of container 100 into a waste removal vehicle. Additional embodiments of container 100 may include only one opening, which universally serves as both a fill opening and discharge opening.

The fill opening 114 and discharge opening 116 may have a wide variety of different shapes and sizes. In the illustrated embodiment of container 100, each of the fill opening 114 and discharge opening 116 have a generally rectangular shape. However, the fill opening and/or the discharge opening of additional embodiments of container 100 may have a variety of different shapes. For example, one or more of the fill opening 114 or discharge opening 116 of additional embodiments of container 100 may have a circular, square, elliptical or other suitable shape. Additional embodiments of container 100 may have more than one fill opening 114 or discharge opening 116. For example, certain additional embodiments of container 100 may include a pair of fill openings 114 or a pair of discharge openings 116, each defined through one or more of walls 102, 104, 106, 108, 110 and 112.

As shown in FIGS. 1A-1B, fill opening 114 is optionally covered by fill opening door 118. Fill opening door 118 includes a plurality of hinge tabs 120. Fill opening door 118 is mounted to upper front wall 110 by a hinge pin 122 which extends through the hinge tabs 118. Hinge pin 122 is affixed to upper front wall 110 in any of a variety of suitable methods, such as by welding or through the use of bolts or other fasteners. While hinge pin 122 of the illustrated embodiment is affixed to the upper front wall 110 to one side of fill opening 114, one or more hinge pins 122 could be affixed to upper front wall 110 in a generally horizontal orientation above or below (or both) fill opening 114 in additional embodiments of container 100. Fill opening door 118 may be mounted to container 100 in a variety of different ways in additional embodiments, including by use of various types of hinges.

Fill opening door 118 is selectively pivoted on hinge pin 122, between a closed position, in which fill opening door 118 covers fill opening 114, and an open position, in which fill opening 114 is uncovered. Fill opening door 118 may have a variety of different suitable shapes, sizes and configurations. Additional embodiments of container 100 may include various different types of doors. For example, in certain embodiments, fill opening door 118 may be a pair of doors that each cover half of fill opening 114, a sliding panel that slides between a closed and open position or a door that rotates between a closed and open position. Furthermore, in additional embodiments, fill opening 114 may be freely accessible at all times and uncovered by a door.

Fill opening door 118 is selectively locked in the closed position by optional securing device 124. While securing device 124 of the illustrated embodiment of container 100 is a padlock, any suitable securing device may be used to secure fill opening door 118 in the closed position in additional embodiments, such as a chain, strap, tie-down, bungee cord, key lock, panel lock, sash lock, deadbolt, dead latch, bolt latch or other type of lock or latch. Additional embodiments of container may also include a securing device to secure fill opening door 118 in the open position or may not include any securing device for securing fill opening door 118.

As shown in FIGS. 1A-1B, discharge opening 116 is optionally covered by discharge opening door 126. Discharge opening door 126 includes a plurality of hinge tabs 128. Discharge opening door 126 is mounted to upper front wall 110 by a hinge pin 130 which extends through the hinge tabs 128. Hinge pin 130 is affixed to upper front wall 110 in any of a variety of suitable methods, such as by welding or through the use of bolts or other fasteners. While hinge pin 130 is affixed to the upper front wall 110 in a generally horizontal orientation below discharge opening 116, one or more hinge pins 130 could be affixed to upper front wall 110 in a generally horizontal orientation above discharge opening 116 or generally vertical orientation to one side (or both sides) of discharge opening 116 in additional embodiments of container 100. Discharge opening door 126 may be mounted to container 100 in a variety of different ways in additional embodiments, including by use of various different types of hinges.

Figure 3:
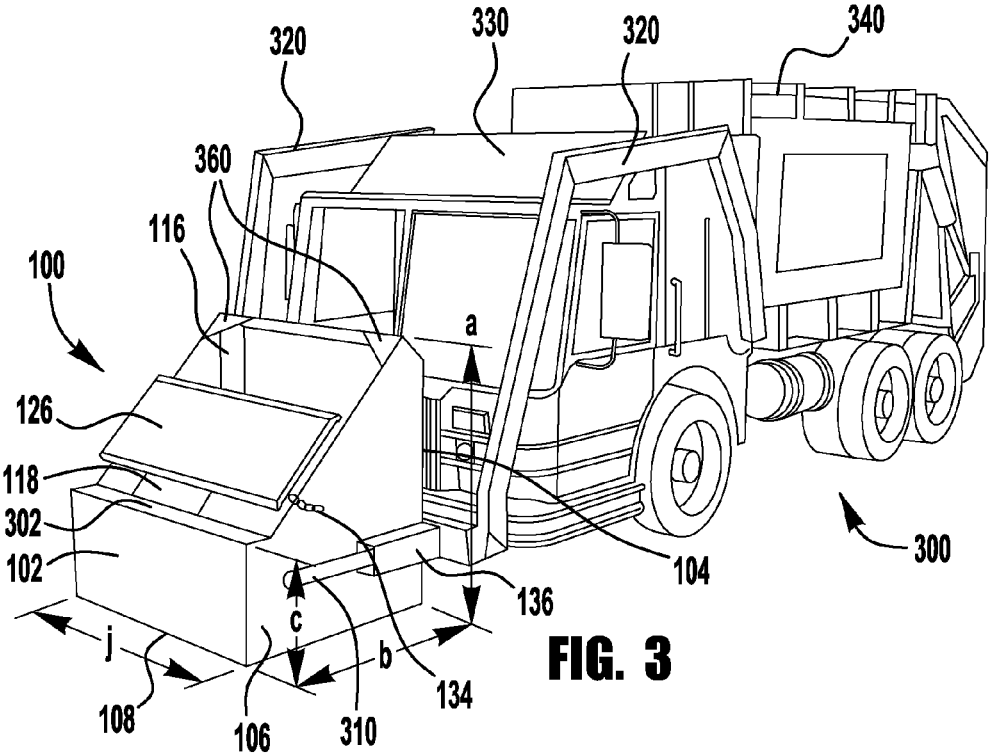
FIG. 3-4 show perspective views of an third exemplary embodiment of a container being lifted by a waste removal vehicle.

Discharge opening door 126 is selectively pivoted on hinge pin 130, between a closed position, in which discharge opening door 126 covers discharge opening 116, and an open position, in which discharge opening 116 is uncovered. In the illustrated embodiment of FIG. 1A, discharge opening door 126 has an upper edge that generally coincides with the top of the container 100 (and the top of discharge opening 116) when it is in the closed position (as shown in FIGS. 1A-1B). When the discharge opening door 126 is moved to the open position, the discharge opening door 126 is pivoted downward to leave the discharge opening 116 unobstructed, with the discharge opening door 126 of the embodiment illustrated in FIGS. 1A-1B generally overlaying a portion of the front wall 110 and a portion of the fill opening door 118 of the container 100 (as shown in FIG. 3) in the open position. Discharge opening door 126 may have a variety of different suitable shapes, sizes and configurations in various embodiments of container 100. Additional embodiments of container 100 may include various different types of doors. For example, in certain embodiments, discharge opening door 126 may be a pair of doors that each cover half of discharge opening 116, a sliding panel that slides between a closed and open position or a door that rotates between a closed and open position. Furthermore, in additional embodiments, discharge opening 116 may be freely accessible at all times and uncovered by a door.

Discharge opening door 126 is selectively locked in the closed position by optional securing device 132, which is a bar lock in the illustrated embodiment that pivots downward to secure discharge opening door 126. Discharge opening door 126 is also selectively locked in the open position by optional securing device 134, which is a chain lock in the illustrated embodiment that connects to a loop (not shown) extending from discharge opening door 126 to retain discharge opening door 126 in the open position. The selective locking of discharge opening door 126 in the open position serves to ensure that the discharge opening 116 will remain unobstructed by the discharge opening door 126 during the emptying of the container 100. While optional securing device 132 of the illustrated embodiment of container 100 is a pivoting bar lock and optional securing device 134 is a chain lock, any suitable securing device may be used to secure discharge opening door 126 in the closed position or open position in additional embodiments, such as a strap, tie-down, bungee cord, key lock, panel lock, sash lock, deadbolt, dead latch, bolt latch or other type of lock or latch. Additional embodiments of container 100 include only one securing device for securing discharge opening door 126 in either the closed position or open position or include no securing device for securing discharge opening door 126. Doors 118, 126 may include one or more handle or other suitable means to assist the opening and closing of the doors 118, 126 by a user.

In various embodiments, doors 118, 126 of container 100 may be made from one or a combination of metals, such as steel, stainless steel, or aluminum. In various additional embodiments, the doors 118, 126 may be made from one or a combination of thermoplastic or elastomeric materials, such as plastic. In yet additional embodiments, various parts of at least one of fill opening door 118, 126 are made from different materials to provide varied properties at discrete portions of the door. For example, in certain embodiments, a portion of doors 118, 126 may be formed of metal while the remaining portions of the doors formed of thermoplastic or elastomeric materials As shown in FIGS. 1A-1B, the illustrated embodiment of container 100 includes a pair of fork-receiving sleeves 136, which are generally identical in structure but located on opposite side walls 106 of container 100. In the illustrated embodiment of container 100, sleeve 136 is a U-shaped channel, with the free ends of the U-shaped main body of sleeve 136 being attached to the side wall 106 by welding, bolts or other suitable attachment methods. One or more gussets, braces or brackets 140 may be optionally located at various locations along sleeve 136 to provide additional support for the sleeve 136.

The rearward end 142 of each sleeve 136 of the exemplary embodiment of container 100 are provided with a flared, reinforced structure which functions to guide the forks of a waste removal vehicle, such as a garbage truck, into fork-receiving opening 144 of sleeve 136. Conventional containers generally include sleeves which have fork-receiving openings that face towards the front of the container so that a waste removal vehicle may approach the front of the container, insert the forks of the waste removal vehicle into the opening and lift the container to either move the container or discharge the contents of the container into the waste removal vehicle.

However, as described more fully herein, the container 100 of the present invention includes sleeves 136 with fork receiving openings 144 that face the rear wall 104 of the container 100 to permit a waste removal vehicle, such as garbage truck, to approach the rear of the container 100, insert the forks of the waste removal vehicle into the opening 144 of sleeves 136 and lift the container 100 from a position rearward of the container to move the container or empty the contents of the container. Additional embodiments of container 100 may include sleeves with fork receiving openings which face towards the front wall of the container to allow a waste removal vehicle to approach and lift the container from the front of the container. Furthermore, additional embodiments of container 100 may include sleeves that each include one fork receiving opening which faces toward the front wall of the container and one fork receiving opening which faces toward the back wall of the container to allow a waste removal vehicle to approach and lift the container from either the front or back of the container.

As shown in FIGS. 1A-1B, the illustrated embodiment of container 100 includes a pair of forklift receiving pockets 146 located beneath the bottom wall 108 of container 100, which are adapted to receive the forks of a forklift or other similar device to permit the forklift to lift, move or empty the contents of container 100. Forklift receiving pockets 146 also serve to raise the bottom wall 108 of container 100 off of the ground or other surface upon which the container 100 is supported to decrease the likelihood that bottom wall 108 becomes corroded or otherwise damaged due to contact with or submersion in standing water or other liquid or moisture located on the surface beneath the container 100. Additional embodiments of container 100 may include legs or supports that serve to raise the bottom wall 108 of container 100 off of the ground but do not receive forks of a forklift or other similar device. Yet further additional embodiments of container 100 may be supported on wheels or sliders that both support the container off the ground and also allow the container to be easily moved or repositioned. Furthermore, in additional embodiments of container 100, the bottom wall 108 of container 100 may rest directly on the supporting surface and not be raised up in any manner.

As shown in FIGS. 1A-1B, the illustrated embodiment of container 100 includes support tray 148 located adjacent fill opening 114. Support tray 148 provides a place for a user of the container 100 to place or rest a waste container, trash can, pail bucket or items, while using the container 100. For example, a user of container 100 could use support tray 148 to support a trash can while the user is opening fill opening door 118 to access fill opening 114. Once fill opening door 118 is opened and the fill opening 114 is accessible, the user could then remove the trash can from support tray 148 and dump the contents of the trash can into container 100 via fill opening. One or more gussets, braces or brackets 150 may be optionally located at various locations along support tray 148 to provide additional support for the support tray 148. Various embodiments of container 100 may be provided without such a support tray 148.

Figure 4:
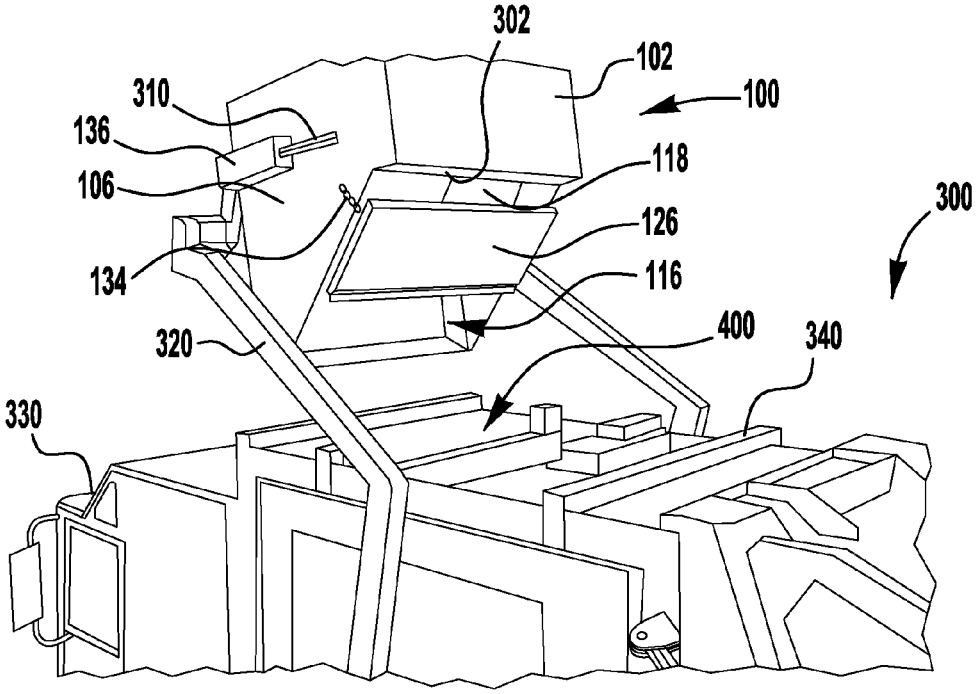

The support tray 148 tray may have a wide variety of different shapes and sizes and may be located at various locations on the container 100. For example, additional embodiments of container 100 may include an support tray which spans the entire width of the front wall of the container. Additional embodiments of container 100 may include more than one support tray or may be provided without a support tray. Yet further additional embodiments of container 100 may include an overall container shape that provides the functions of the support tray. For example, additional embodiments of container 100 may have a six-sided shape (when viewed from the side) that includes a generally flat, horizontal section 302 that spans between the top of the front wall and the lower edge of the angled, upper front wall (as shown in FIGS. 3-4). This generally flat, horizontal section can be used by a user of the container 100 to rest garbage cans, pails, buckets or other items when using the container.

As shown in FIG. 1A, the illustrated embodiment of container 100 has an overall height "a" and depth "b". The distance between the support surface and the top of front wall 102 of the illustrated embodiment of container is distance "c". As shown in FIGS. 1A-1B, the fill opening door 118 of the illustrated embodiment of container 100 has a length "d" and width "e" and the discharge opening door 126 has a length "f" and width "g". As shown in FIG. 1A, the forklift receiving pockets 146 have a height "h" and the bottom of sleeve 136 is raised from the support surface a distance "i". As shown in FIG. 1B, the illustrated embodiment of container 100 has an overall width of "j". The angled, upper front wall 110 has a length "o". Optional, non-limiting, dimension values are provided in Table 1 set forth below. However, additional embodiments of the container 100 may have a variety of dimensions different from those in Table 1. The dimensions of the container 100 are generally determined taking into consideration a variety of factors, including but not limited to the desired performance of the container, the expected contents of the container, and the expected surrounding environment or planned location of the container.

TABLE 1

Exemplary Container Dimensions

| | | Representative Dimensions (Inches) |
|---|---|---|
| Container Height | a | 73¼ |
| Container Depth | b | 53 |
| Distance Between Support Surface and Top of Front Wall | c | 27⅞ |
| Fill Opening Door Length | d | 31⅜ |
| Fill Opening Door Width | e | 31⅜ |
| Discharge Opening Door Length | f | 30 |
| Discharge Opening Door Width | g | 74 |
| Height of Forklift Receiving Pocket | h | 3 |
| Distance Between Support Surface and Bottom of Sleeve | i | 25⅝ |
| Container Width | j | 72 |
| Vertical Distance Between Bottom Wall and Bottom of Fill Opening | l | 28 |
| Length of angled, upper front wall | o | 64½ |

FIGS. 2A-2B show a second exemplary embodiment of a container 100', which is a modified version of the container 100 shown in FIGS. 1A-1B. The prime symbol is utilized in these figures to indicate elements which are similar and yet not identical to elements in FIGS. 1A-1B. Referring to FIGS. 2A-2B, the container 100' has a front wall 102', a rear wall 104', a pair of side walls 106' and a bottom wall 108'. The illustrated embodiment of the container 100' includes an angled, upper front wall 110'. As shown in FIG. 2A, the upper front wall 110' slopes from the front wall 102' to meet the upper rear wall 104' to generally enclose the container 100'. As shown in FIG. 2A, the exemplary embodiment of the container 100' has a generally four sided polygonal shape when viewed from the side and does not include the sloped, upper rear wall from the embodiment of container 100 illustrated in FIGS. 1A-1B. This four sided polygonal shape without a sloped, upper rear wall of container 100' may be provided in certain embodiments to prevent waste from becoming trapped in the portion of the container formed between the rear wall 104, sloped upper rear wall 112 and angled, upper front wall 110 of container 100 illustrated in FIGS. 1A-1B when the container 100 is being emptied in accordance with the method described in connection with FIGS. 6A-6B discussed below. A determination of whether or not a sloped, upper rear wall is provided with a certain embodiment of the container is made taking into consideration a variety of factors, including but not limited to the desired performance of the container and the expected contents of the container.

As shown in FIG. 2A, the illustrated embodiment of container 100' has an overall height a' and depth b'. The distance between the support surface and the top of front wall 102' of the illustrated embodiment of container is distance c'. As shown in FIGS. 2A-2B, the fill opening door 118' of the illustrated embodiment of container 100' has a length d' and width e' and the discharge opening door 126' has a length f' and width g'. As shown in FIG. 2A, the forklift receiving pockets 146' have a height h' and the bottom of sleeve 136' is raised from the support surface a distance i'. As shown in FIG. 2B, the illustrated embodiment of container 100' has an overall width of j'. The angled, upper front wall 110 has a length o'. Optional, non-limiting, dimension values for the embodiment of container illustrated in FIGS. 2A-2B are provided in Table 2 set forth below. However, additional embodiments of the container 100' may have a variety of dimensions different from those in Table 2. The dimensions of the container 100' are generally determined taking into consideration a variety of factors, including but not limited to the desired performance of the container, the expected contents of the container, and the expected surrounding environment or planned location of the container.

TABLE 2

Exemplary Container Dimensions

| | | Representative Dimensions (Inches) |
|---|---|---|
| Container Height | a' | 68¾ |
| Container Depth | b' | 53 |
| Distance Between Support Surface and Top of Front Wall | c' | 27⅞ |
| Fill Opening Door Length | d' | 31⅜ |
| Fill Opening Door Width | e' | 31⅜ |
| Discharge Opening Door Length | f' | 30 |
| Discharge Opening Door Width | g' | 74 |
| Height of Forklift Receiving Pocket | h' | 3 |
| Distance Between Support Surface and Bottom of Sleeve | i' | 25⅝ |
| Container Width | j' | 72 |
| Vertical Distance Between Bottom Wall and Bottom of Fill Opening | l' | 28 |
| Length of angled, upper front wall | o' | 65¼ |

Containers of the present disclosure are intended for use with the collection, storage and transport of a variety of materials, including waste and refuse material. The waste containers of the present invention are particularly useful for the collection, storage and transporting of organic waste material, including but not limited to organic waste generated by the handling, storage, sale, preparation, cooking, and serving of foods, such as food scraps, grease, fruits, vegetables, dairy products, egg shells, coffee grounds, bread, grain, cheese, meat, poultry, fish, seafood, bones, fat, blood, entrails, or other animal tissue and organic waste generated in the process of landscape maintenance, such as leaves, branches, grass cuttings, or other plant material.

In use, container 100 is placed in a desired location on a sufficient support surface. A user of the container 100 opens fill opening door 118 to access fill opening 114 to load waste or other materials into container 100. Support tray 148 may be used to support a receptacle, such as a garbage can, during the loading of waste or other materials into container 100. As discussed previously, a user could also open discharge opening door 126 to access discharge opening 116 to load waste or other materials into the container 100. For example, if the user desires to deposit a large-sized object into container 100 that would not fit through fill opening 114, discharge opening 116 could be used. As discussed previously, certain additional embodiments of container 100 do not include doors 118, 126. In addition, additional embodiments are provided with multiple fill openings 114 and or discharge openings 116 or one universal opening that serves as both the fill opening and discharge opening.

Securing device 124 may be used to lock fill opening door 118 in the closed position to prevent items from being removed from the container 100, to prevent undesired objects being placed into the container 100, and to prevent undesired entry into the container 100 by humans or animals. Similarly, securing device 132 may be used to lock discharge opening door 126 in the closed position. As discussed previously, certain additional embodiments of container 100 may be provided without such securing devices.

Various embodiments of the container 100 may be provided with an optional odor reduction systems used to minimize the odor that may emanate from the container due to the contents of the container. In certain such embodiments, the odor reduction system may be an air filtration system.

When container 100 becomes full or it is otherwise desired that container 100 be emptied, a waste removal vehicle, such as a front loading garbage truck, is used to empty the container 100, as illustrated in FIGS. 3-4. As shown in FIG. 3, when it is desired that container 100 be emptied, discharge opening door 126 is moved to the open position, thus leaving discharge opening 116 unobstructed. Securing device 134 may be optionally used to secure discharge opening door 126 into the open position to prevent discharge opening door 126 from moving during the emptying of the container 100 and potentially obstructing discharge opening 116. As shown in FIG. 3, when the discharge opening door 126 is moved to the open position, the discharge opening door 126 generally overlays a portion of the front wall 110 and a portion of the fill opening door 118 of the container 100 (as shown in FIG. 3). Preferably, fill opening door 118 is secured in the closed position during the emptying of the container 100 to prevent material from exiting fill opening 114 during the emptying of the container 100. However, additional embodiments of container 100 may be provided with a discharge opening door that is dimensioned, configured and oriented in a manner so that discharge opening door serves to close the fill opening when the discharge opening door is secured in the open position. Additional embodiments of the container 100 may also be provided with a discharge opening door 126 that moves from the closed position to the open position in a different manner. For example, in various additional embodiments, the discharge opening door 126 may be mounted to upper front wall 110 by a hinge pin 130 which is affixed to the upper front wall 110 in a generally horizontal orientation above the discharge opening 116. In such embodiments, the discharge opening door may be moved to the open position by pivoting the discharge opening door 126 upwardly from the discharge opening 116. In such embodiments, the discharge opening door 126 may generally overlay a portion of the angled, upper rear wall 112 and/or the rear wall 104 in the opened position. The discharge opening door 126 may be optionally locked in both the closed position and open position in such embodiments in a similar manner as the discharge opening door of the embodiment illustrated in FIGS. 1A-1B.

As shown in FIG. 3, a waste removal vehicle 300, such as a front loading garbage truck approaches rear wall 104 of container 100. It should be understood that waste removal vehicle 300 may approach the front wall 103 of container 100 in additional embodiments. Fork assembly 310 of the waste removal vehicle 300 is inserted into fork-receiving openings 144 of sleeves 136. Container 100 is lifted from the ground or other support surface using powered lifting arms 320 of the waste removal vehicle 300. The powered lifting arms 320 and the fork assembly of the waste removal vehicle 300 are adapted to lift container 100 in a generally arcuate path from the support surface, up above a cab 330 of the waste removal vehicle 300 and back towards a hopper portion 340 of the waste removal vehicle 300.

As shown in FIG. 4, the hopper portion 340 of the waste removal vehicle 300 includes a fill opening 400 to permit loading of the hopper portion 340. Waste removal vehicle 300 is adapted to position container 100 in a generally upside down orientation above fill opening 400 of the hopper portion 340, as shown in FIG. 4, to facilitate the emptying of the contents of container 100 through the discharge opening 116 into the fill opening 400 of the hopper portion 340. In certain conventional waste removal vehicles, fork assembly 310 is independently movable with respect to powered lifting arms 320 during the lifting of container 100 to tilt or rotate the container relative to powered lifting arms 320 so as to further facilitate the proper location, orientation and alignment of the container 100 above opening 400 of the hopper portion 340 of the waste removal vehicle 300. The illustrated embodiment of container 100 includes a pair of baffles 360 for directing and controlling flow of the contents of the container 100 as the contents of the container 100 are being emptied into the waste removal vehicles. In certain additional embodiments of container 100, a variety of baffles, fins, plates, filters, screens, or other fluid directing or control devices may be provided to direct, control, filter and or meter the flow of the contents of the container 100 as the contents of the container 100 are being emptied into the waste removal vehicle. When the contents of container 100 are emptied into the hopper portion 340 of the waste removal vehicle 300, the container 100 is replaced to its original position by the powered lifting arms 320 and fork assembly 310 is removed from sleeves 136. While the emptying of container of the present invention is described in connection with a front-loading garbage truck, the container of the present invention can also be emptied by other types of waste removal vehicles, such as a rear-loading garage truck. In certain waste removal vehicles, the contents of the waste vehicle are periodically compacted through the use of a compactor.

When emptying the contents of waste or refuse containers, it is undesirable for the contents of the container to spill out or otherwise exit the container before the container is in the proper position for emptying the contents of the container into the hopper or other waste receiving portion of the waste removal vehicle. For example, it is undesirable for contents of a waste or refuse container to exit the container and fall upon the cab or other portion of the waste removal vehicle, thus damaging or dirtying the waste removal vehicle and potentially injuring the driver or other occupants of the waste removal vehicle. As an additional concern, the waste, such as organic waste, that is collected, stored and transported in waste and refuse containers often include potentially harmful waste, some of which may be in liquid form. If this liquid waste, such as for example blood from meat production/processing or chemical waste from various industrial procedures, were to spill onto the cab of the waste removal vehicle 300 or the ground below, it could present various health and safety risks.

Figure 5:
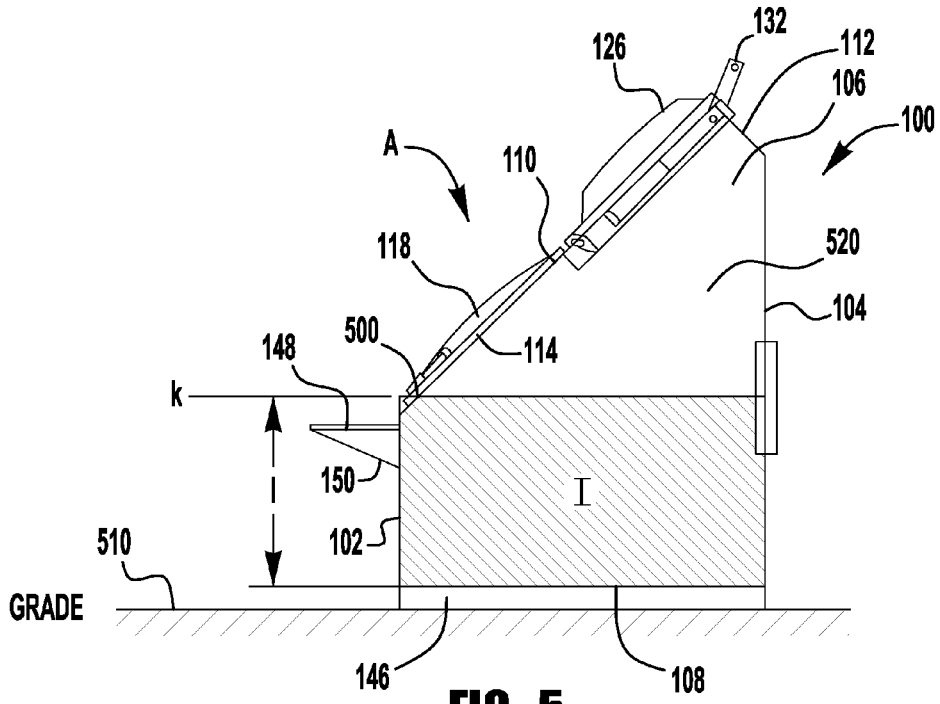
FIG. 5 shows a side view of the embodiment of the container shown in FIGS. 1A-1B showing the capacity of the container below the bottom edge of the fill opening with the container on a substantially flat surface.
Figure 5A:
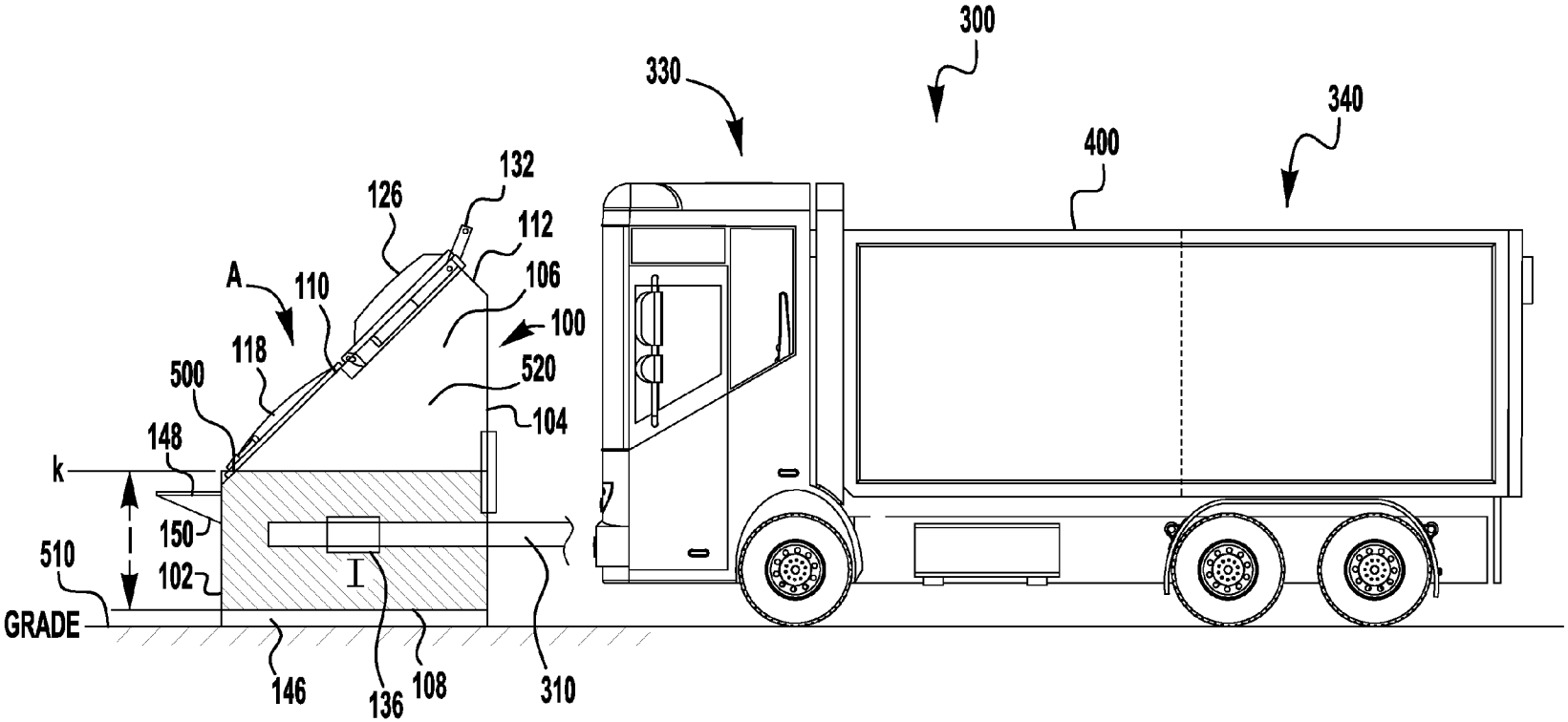
FIG. 5A schematically shows the embodiment of the container shown in FIGS. 1A-1B on a substantially flat surface with fork assembly of a waste removal vehicle inserted into the fork-receiving sleeves of container

Various embodiments of the container 100 according to the present disclosure are adapted to prevent the contents of the container 100 from spilling out or otherwise exiting the container during the emptying of the container until the container is in the proper position and orientation relative to the waste removal vehicle 300. As shown in FIG. 5, the illustrated embodiment of container 100 has an internal capacity portion "I" below the horizontal plane "k," which generally coincides with the bottom edge 500 of fill opening 114, when container 100 is in an upright position "A" on a level support surface 510. In the illustrated embodiment of container 100 according to the exemplary dimensions set forth in Table 1, the distance "l" between the bottom wall of the container 108 and plane "k" is approximately 27⅝ inches, however this distance can vary in additional embodiments of the container. In the illustrated embodiment of container 100 according to the exemplary dimensions set forth in Table 1, the internal capacity portion "I" has an approximate volume of 2.3 cubic yards. However this internal capacity can vary in additional embodiments of the container and is directly dependent upon the various dimensions of the container. Referring to FIG. 5A, the container 100 is illustrated schematically in position "A," with fork assembly 310 of waste removal vehicle 300 inserted into sleeves 136 of container 100.

The walls 102, 104, 106, 108, 110 and 112 of the non-limiting, illustrated embodiment of container 100 are constructed and joined, via welds or otherwise, so as to be generally water-tight or leak proof. However, depending upon the desired functionality and performance of the container and/or the intended contents of the container, additional embodiments of container 100 may not be water-tight. While the entirety of internal cavity 520 of container 100 may be filled with material, such as waste or refuse material, internal capacity portion "I" represents the leak proof, liquid capacity of container 100 when container 100 is in the upright position "A" on a level support surface 510. If the level of liquid within the illustrated embodiment of container 100 rises above plane "k," which coincides with the bottom edge 500 of fill opening 114, such liquid may leak or seep out of container 100 via fill opening 114. It should be understood that the volume of leak proof, liquid capacity "I" of container 100 may be changed by altering the dimensions of container 100 or the location of fill opening 114 and/or discharge opening 116.

Figure 6:
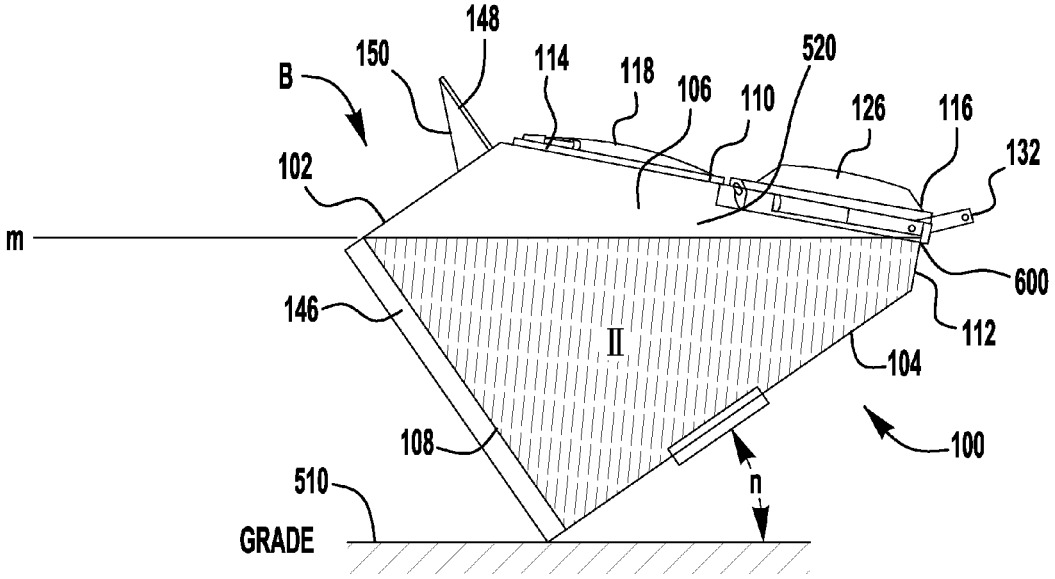
FIG. 6 shows a side view of the embodiment of the container shown in FIGS. 1A-1B showing the capacity of the container below the top edge of the discharge opening when the container is in a tilted loading position.
Figure 6A:
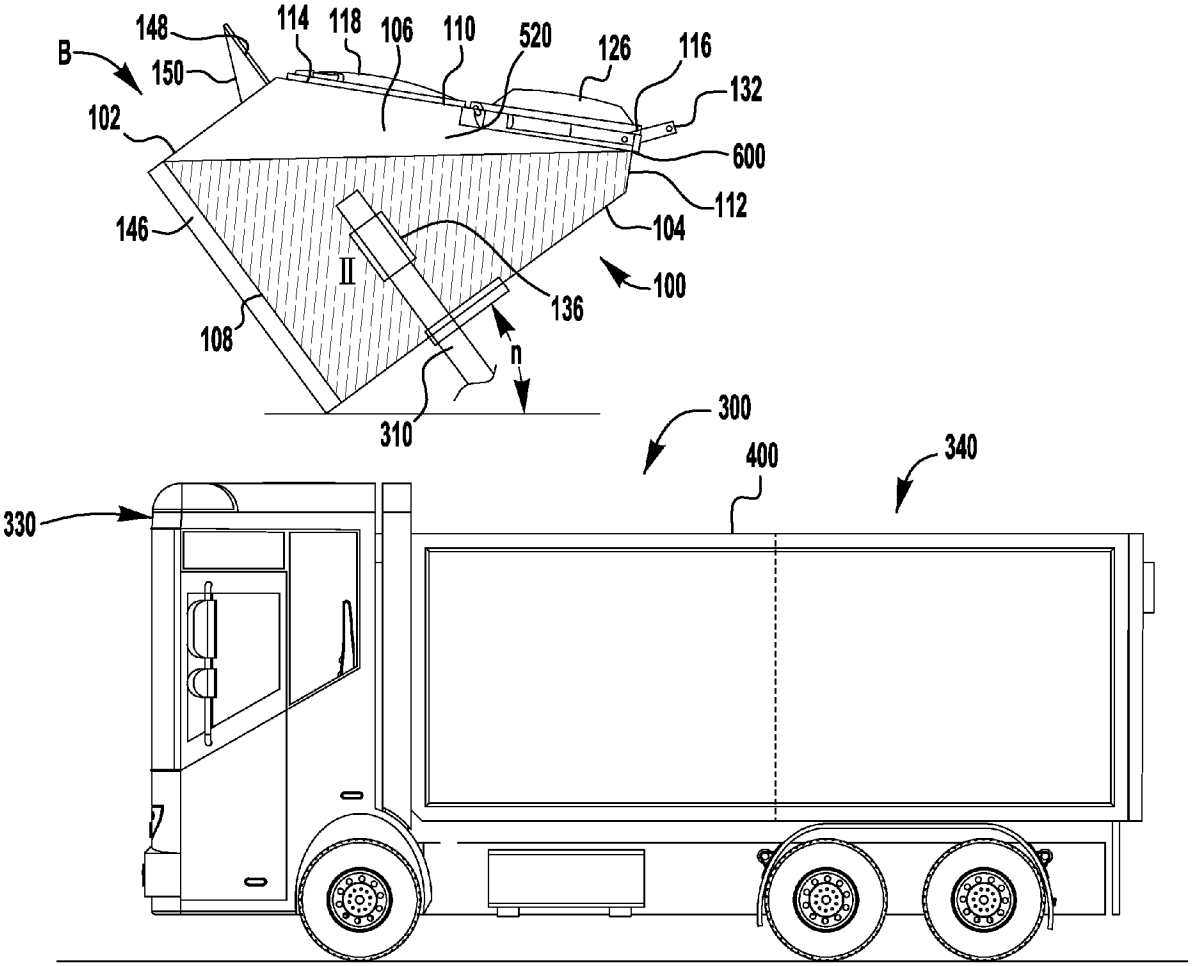
FIG. 6A schematically shows the embodiment of the container shown in FIGS. 1A-1B in the position of FIG. 6 above a waste removal vehicle.

As shown in FIG. 6, the illustrated embodiment of container 100 has an internal capacity portion "II" below the horizontal plane "m," which generally coincides with the top edge 600 of discharge opening 116, when container 100 is in a tipped-back position "B" with back wall 104 at an angle "n" relative to support surface 510. In the illustrated embodiment of container 100 according to the exemplary dimensions set forth in Table 1, the angle "n" is approximately 35°, however this angle can vary in additional embodiments of the container. In the illustrated embodiment of container 100 according to the exemplary dimensions set forth in Table 1, the internal capacity portion "II" has an approximate volume of 2.86 cubic yards, however this internal capacity can vary in additional embodiments of the container and is directly dependent upon the various dimensions of the container.

As previously discussed, the walls 102, 104, 106, 108, 110 and 112 of the non-limiting, illustrated embodiment of container 100 are constructed and joined, via welds or otherwise, so as to be generally water-tight or leak proof. Internal capacity portion "II" of container 100 represents the leak proof, liquid capacity of container 100 when container 100 is in the tipped-back position "B" with back wall 104 at an angle "n" relative to support surface 510. If the level of liquid within the illustrated embodiment of container 100 rises above plane "m," which coincides with the top edge 600 of discharge opening 116, such liquid may leak or seep out of container 100 via discharge opening 116. It should be understood that the volume of leak proof, liquid capacity "II" of container 100 may be varied by altering the dimensions of container 100 or the location of fill opening 114 and/or discharge opening 116.

Figure 6B:
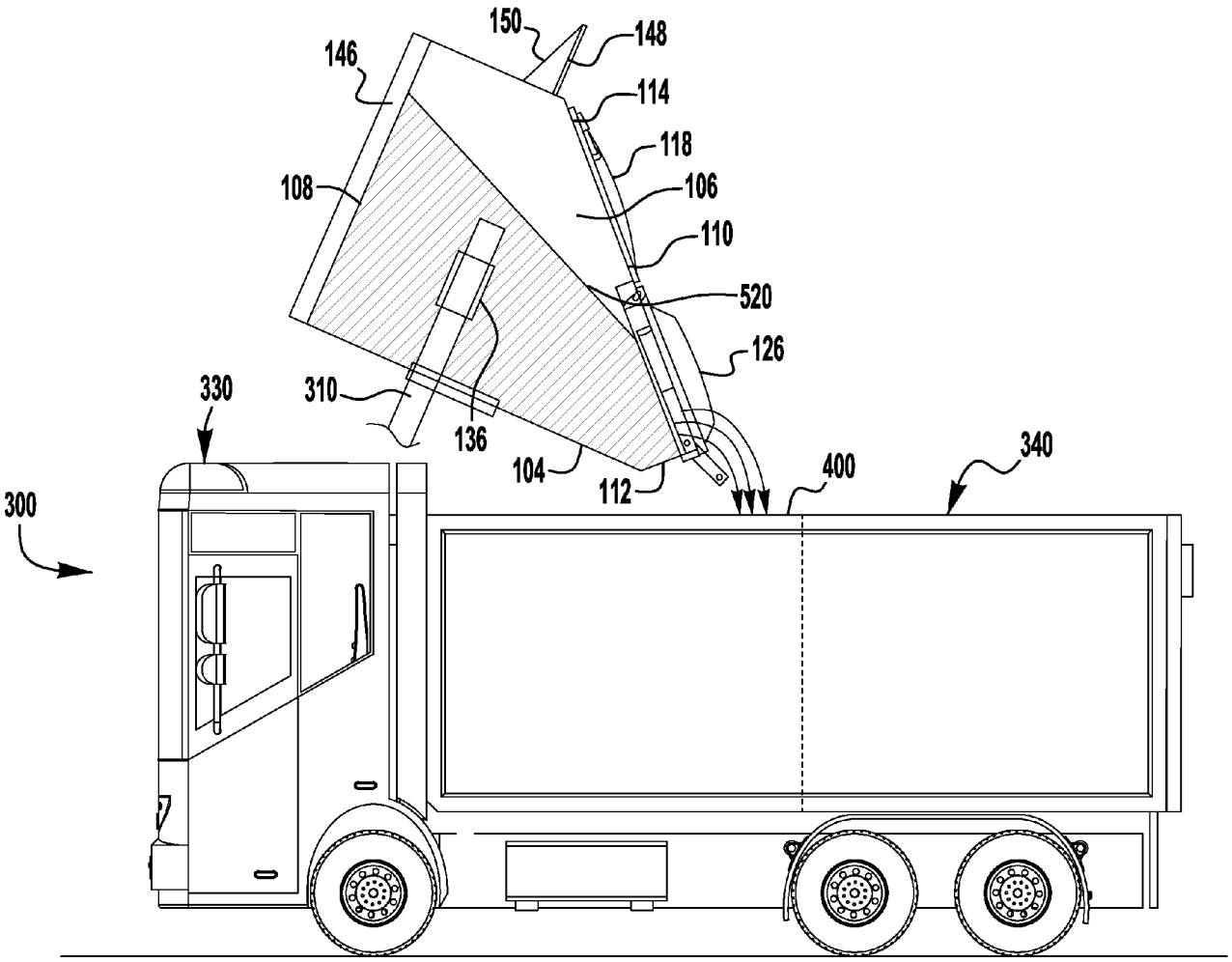
FIG. 6B schematically shows the embodiment of the container shown in FIGS. 1A-1B in an emptying position above a waste removal vehicle.

The tipped-back position "B" of container 100 with back wall 104 at an angle "n" relative to support surface 510, represents the angle which container 100 is typically tilted by a waste removal vehicle 300, such as a front loading garbage truck, prior to the point when it is in the proper location/orientation above opening 400 of the hopper portion 340 of the waste removal vehicle 300. While FIG. 6 depicts container 100 contacting the support surface 510, it should be understood that container 100 is typically raised off of the support surface 510 by a waste removal vehicle 300 (as shown schematically in FIG. 6A), and support surface 510 is included in FIG. 6 for illustrative purposes only to show the orientation of container 100 relative to the grade or level of support surface 510 when in position B. As such, it is desirable that no appreciable amount of liquid or other material spill from or otherwise exit container 100 prior to the time when container 100 reaches position "B," as any liquid or other material exiting the container 100 prior to the container 100 reaching position "B" may drop on the waste removal vehicle 300 or the surrounding ground or other support surface 510. Referring now to FIG. 6B, the container 100 is illustrated schematically in an emptying position after it has been tilted past position "B" and the contents of container 100 begin to pour into opening 400 of the hopper portion 340 of the waste removal vehicle 300.

The volume of internal capacity portion "I" (i.e., approximately 2.3 cubic yards) of the illustrated embodiment of container 100 is smaller than the volume of internal capacity portion "II" (i.e., approximately 2.86 cubic yards). As the volume of internal capacity portion "I" is smaller than the volume of internal capacity portion "II," even if internal capacity portion "I" is entirely filled with liquid or other material when container 100 is in upright position "A", no more than an incidental amount, if any, of this liquid or other material will have spilled out of container 100 via discharge opening 116 when container 100 has been tilted back to tipped-back position "B". In this manner, the likelihood that any liquid or other contents of container 100 will spill out or otherwise exit container 100 prior to the point when it is in the proper location/orientation above opening 400 of the hopper portion 340 of the waste removal vehicle 300 is significantly decreased.

While the back wall 104 of container 100 is located at an angle "n" equal to approximately 35° relative to support surface 510, it should be understood that additional embodiments of container 100 may be adapted to prevent the contents of the container 100 from spilling out or otherwise exiting the container when the container is in a variety of positions relative to the support surface 510. For example, additional embodiments of container 100 may be adapted to prevent the contents of container from exiting the container prior to the point when rear wall 104 is located at a 20° angle relative to support surface 510 or some other angle. In additional embodiments of the container 100, the various dimensions of the container 100 may be adapted to ensure that the volume of the liquid capacity of the container when the container is in an upright position is smaller than the volume of the liquid capacity of the container in tilted back position, with the back wall in any variety of angles relative to the support surface. In yet additional embodiments, which are tilted forward relative to the support surface during the emptying of the container, the container of the present application may be configured to ensure that the volume of the liquid capacity of the container when the container is in an upright position is smaller than the volume of the liquid capacity of the container in tilted forward position, with the front wall in any variety of angles relative to the support surface.

Figure 7:
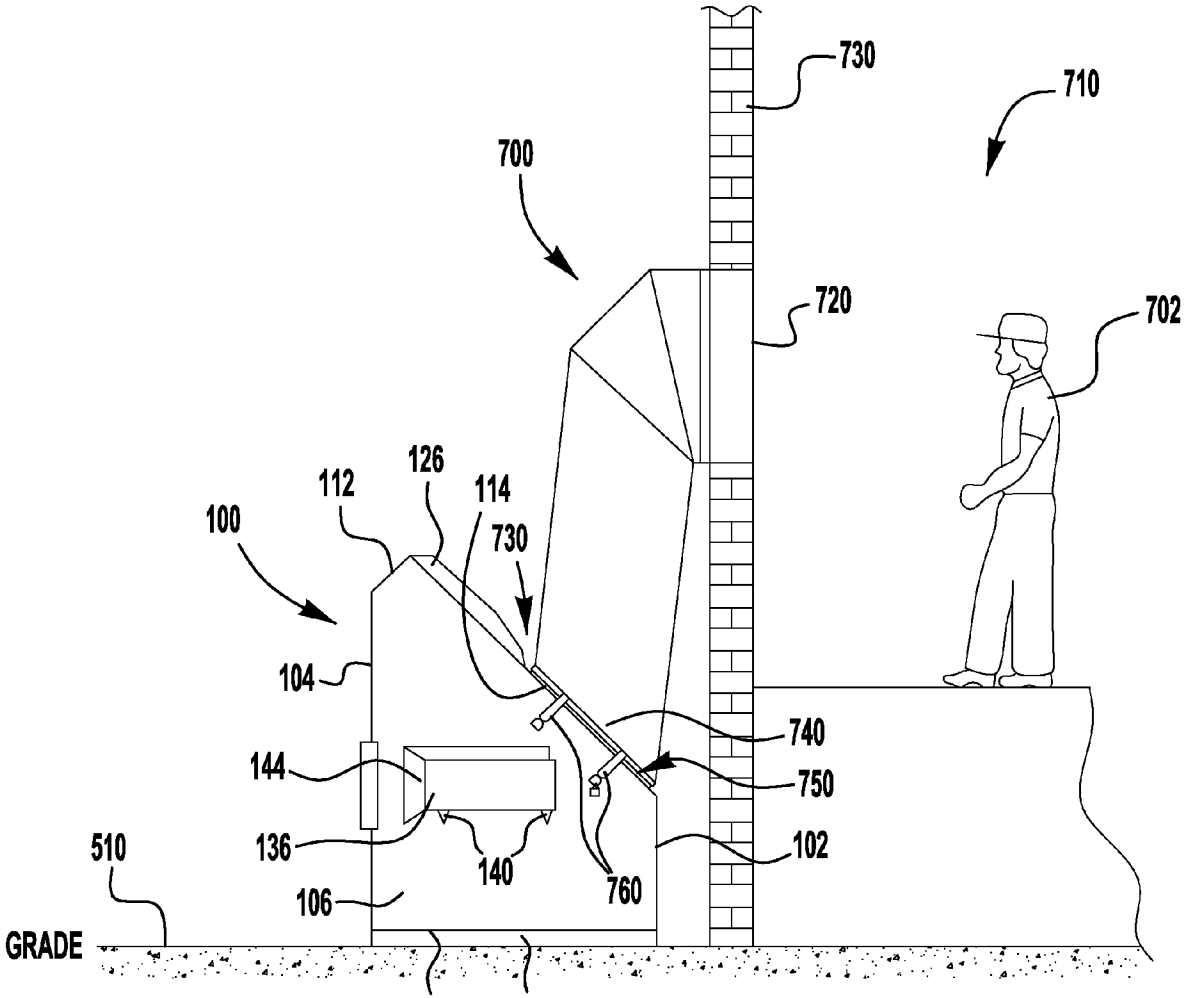
FIG. 7 shows a side view of an additional embodiment of the container which includes a loading chute.

Referring now to FIG. 7, an additional embodiment of container 100 is illustrated which includes an optional loading chute 700. Loading chute 700 is adapted to allow a user 702 of container 100 to load container 100 from the interior 710 of a building or other structure. The loading chute 700 of various embodiments can have a variety of shapes and configurations. For example, loading chute may have a generally rectangular or circular interior cross-section. Loading chute 700 may be constructed from a variety of suitable materials, such as one or a combination of metals, such as steel or aluminum, or one or a combination of thermoplastic or elastomeric materials.

Loading chute 700 includes an inlet end 720 which is accessible from the interior 710 of a building other structure. Loading chute 700 of various embodiments of container 100 may traverse or pass through one or more walls 730 of a structure or other similar barriers to reach the location of the container 100.

The loading chute 700 of the illustrated embodiment of container in FIG. 7 includes a container interface 730 where a discharge end 740 of loading chute 700 engages fill opening 114 of container 100 to create a seal between loading chute 700 and container 100. Various suitable devices may be used as the container interface 730 in various embodiments. For example, in the embodiment of container 100 illustrated in FIG. 7, the container interface 730 includes a gasket 740 constructed from a suitable material, such as rubber or neoprene, that provides a suitable seal with the container 100. In yet additional embodiments, the loading chute 700 may be provided without a container interface 730. For example, the discharge end 740 of loading chute 700 may simply be located above a fill opening 114 of container 100 and contents of the loading chute 700 may drop into container 100 from a distance. In yet additional embodiments, the loading chute may not be located above the container 100, but rather be a generally horizontal chute on the same approximate horizontal level of the fill opening 114.

The loading chute 700 may include one or more optional securing devices 750 for securing the loading chute 700 to the container 100. In the illustrated embodiment, the securing devices 750 are magnetic lockable draw latches 760 that secure the loading chute 700 to container 100. In additional embodiments, the securing devices 750 may be releasable securing devices, such as magnetic latches or friction fit latches, that permit the loading chute 700 to easily detach from the container 100 without being damaged and without any need for user interaction when the container 100 is lifted by a waste removal vehicle 300 or otherwise moved.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasable or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A container comprising:

a front wall comprising a top front edge and a bottom front edge;

a rear wall comprising a top rear edge;

a pair of side walls;

a bottom wall;

an angled, upper front wall sloping upward from the top front edge toward the rear wall;

an angled, upper rear wall sloping upward from the top rear edge toward the front wall;

a discharge opening defined within the angled, upper front wall, wherein the discharge opening comprises a top edge;

a fill opening defined within the same angled, upper front wall as the discharge opening, wherein the fill opening comprises a bottom edge, wherein the top edge of the discharge opening is positioned above the fill opening, and wherein the bottom edge of the fill opening is positioned below the discharge opening;

a sleeve attached to each of the pair of side walls, wherein each of the sleeves comprises a fork-receiving opening configured to receive a fork assembly of a waste removal vehicle;

the container having a first volume portion defined by the front wall, the rear wall, the pair of side walls, the bottom wall, and a first plane parallel with the bottom wall, the first plane coinciding with the bottom edge of the fill opening; and the container having a second volume portion defined by the rear wall, the pair of side walls, the bottom wall, and a second plane that coincides with the bottom front edge of the front wall and the top edge of the discharge opening;

wherein the second volume portion is greater than the first volume portion.

2. The container of claim 1, wherein the angled, upper rear wall slopes upward to meet the angled, upper front wall.

3. The container of claim 1, further comprising a discharge opening door for selectively closing the discharge opening.

4. The container of claim 3, wherein the discharge opening door is pivotable on a hinge pin between a closed position and an open position, and wherein the hinge pin is located on the angled, upper front wall below the discharge opening in a generally horizontal orientation.

5. The container of claim 4, further comprising a securing device for securing the discharge opening door in the closed position.

6. The container of claim 5, wherein the securing device is a pivoting bar lock.

7. The container of claim 5, further comprising a securing device for securing the discharge opening door in the open position.

8. The container of claim 1, further comprising a fill opening door for selectively closing the fill opening.

9. The container of claim 8, wherein the fill opening door is pivotable on a hinge pin between a closed position and an open position, and wherein the hinge pin is located on the angled, upper front wall adjacent the fill opening.

10. The container of claim 9, further comprising a securing device for securing the fill opening door in the closed position.

11. The container of claim 1, further comprising a plurality of fork receiving pockets positioned on the bottom wall of the container.

12. The container of claim 1, further comprising a support tray positioned on the front wall of the container.

13. The container of claim 1, further comprising a load chute, wherein the load chute comprises a discharge end in communication with the fill opening of the container and an inlet end.

14. The container of claim 13, wherein the load chute further comprises a container interface which creates a seal between the load chute and the container.

15. The container of claim 14, wherein the load chute further comprises at least one securing device for attaching the load chute to the container.

16. A container comprising:

a front wall comprising a top front edge and a bottom front edge;

a rear wall comprising a top rear edge;

a pair of side walls;

a bottom wall;

an angled, upper front wall sloping from the top front edge toward the top rear edge of the rear wall;

an angled, upper rear wall sloping from the top rear edge toward the top front edge of the front wall;

a fill opening defined within the angled, upper front wall, wherein the fill opening comprises a bottom edge;

a fill opening door for selectively closing the fill opening;

a discharge opening defined within the same angled, upper front wall as the fill opening, wherein the discharge opening comprises a top edge, wherein the top edge of the discharge opening is positioned above the fill opening, and wherein the bottom edge of the fill opening is positioned below the discharge opening;

a discharge opening door for selectively closing the discharge opening; and a sleeve attached to each of the pair of side walls, wherein each of the sleeves comprise a fork-receiving opening configured to receive a fork assembly of a waste removal vehicle;

the container having a first volume portion defined by the front wall, the rear wall, the pair of side walls, the bottom wall, and a first plane parallel with the bottom wall, the first plane coinciding with the bottom edge of the fill opening; and the container having a second volume portion defined by the rear wall, the pair of side walls, the bottom wall, and a second plane that coincides with the bottom front edge of the front wall and the top edge of the discharge opening;

wherein the second volume portion is greater than the first volume portion.

17. The container of claim 16 wherein the angled, upper rear wall slopes from the top rear edge of the rear wall to meet the angled, upper front wall.

18. The container of claim 16 wherein the fill opening door is pivotable on a first hinge pin between a closed position and an open position, wherein the first hinge pin is located on the angled, upper front wall adjacent the fill opening.

19. The container of claim 18 wherein the discharge opening door is pivotable on a second hinge pin between a closed position and an open position, wherein the second hinge pin is located on the angled, upper front wall below the discharge opening in a generally horizontal orientation.

20. A container comprising:

a front wall;

a rear wall;

a pair of side walls;

an angled, upper front wall sloping from a top of the front wall toward a top of the rear wall;

a fill opening defined within the angled, upper front wall;

a discharge opening defined above the fill opening within the angled, upper front wall; and a pair of sleeves attached to opposite sides of the container;

wherein the container has a first leak-free capacity when the container is in an upright position on a level support surface;

wherein the container has a second leak-free capacity when the container is in a predetermined tilted position relative to the level support surface, wherein the predetermined tilted position is approximately 35 degrees offset from the upright position, and wherein the first leak-free capacity is less than the second leak-free capacity.

21. The container of claim 20, wherein the first leak-free capacity is the volume of the internal portion of the container below a horizontal plane coinciding with a bottom edge of the fill opening when the container is in the upright position on the level support surface.

22. The container of claim 2, wherein the second leak-free capacity is the volume of the internal portion of the container below a horizontal plane coinciding with a top edge of the discharge opening when the container is in the predetermined tilted position relative to the level support surface.

23. The container of claim 20, wherein each of the sleeves are positioned with fork receiving openings being accessible from the rear wall of the container for inserting a fork assembly of a waste removal vehicle into the sleeves and lifting the container from a position rearward of the container.

* * * * *